US007000797B2

(12) United States Patent
Forrest et al.

(10) Patent No.: US 7,000,797 B2
(45) Date of Patent: Feb. 21, 2006

(54) CAN END FOR A CONTAINER

(75) Inventors: Randy G. Forrest, Park Ridge, IL (US); Timothy Turner, Pecatonica, IL (US)

(73) Assignee: Rexam Beverage Can Company, Chicago, IL (US)

( * ) Notice: Subject to any disclaimer, the term of this patent is extended or adjusted under 35 U.S.C. 154(b) by 98 days.

(21) Appl. No.: 10/317,636

(22) Filed: Dec. 12, 2002

(65) Prior Publication Data

US 2003/0080132 A1 May 1, 2003

Related U.S. Application Data

(63) Continuation of application No. 09/748,927, filed on Dec. 27, 2000, now abandoned.

(51) Int. Cl.
*B65D 17/34* (2006.01)

(52) U.S. Cl. ..... 220/269; 413/6; 220/906

(58) Field of Classification Search ..... 220/269, 220/270, 906, 619, 620; 413/4, 6, 12, 16, 413/17

See application file for complete search history.

(56) References Cited

U.S. PATENT DOCUMENTS 3,215,305 A 11/1965 Frankenberg
3,259,265 A 7/1966 Stuart (Continued)

FOREIGN PATENT DOCUMENTS

EP 0 103 074 A2 3/1984

(Continued)

OTHER PUBLICATIONS

Reynolds Metals Company Can Division, Advertising Literature, "Reynolds Develops Large-Opening Ends," Oct. 24, 1994.

(Continued)

*Primary Examiner*—Lien M. Ngo
(74) *Attorney, Agent, or Firm*—Wallenstein Wagner & Rockey, Ltd.

(57) ABSTRACT

An end member for a container having a circumferential sidewall, the end member having a peripheral seaming edge adapted to be integrally connected to the sidewall, and having a central panel wall with a means for opening a frangible panel segment of the panel wall is claimed. The end member comprises a deboss panel recessed in the central panel. The deboss panel has first and second spaced apart end portions joined by first and second sidewalls. The first spaced apart end portion has an apex and first and second arcuate portions. A distance between the first and second arcuate portions is defined by a plurality of progressively increasing secant lengths located in spaced relation from the apex. A score groove is located within the deboss panel defining an outer perimeter of the frangible panel segment. The score groove has a first end and a second end joined to the first end by a curvilinear segment. The first end and the second end are separated by a generally linear hinge segment of the central panel wall. The curvilinear segment includes first and second curved segments joined by a transition point located adjacent the apex of the deboss panel. The generally arcuate transition region is defined by a plurality of progressively increasing chordal lengths located in spaced relation from the apex of the deboss panel. A ratio of the plurality of progressively increasing secant lengths to the progressively increasing chordal lengths increases along respective lengths of the first and second arcuate portions of the deboss panel.

32 Claims, 3 Drawing Sheets

U.S. PATENT DOCUMENTS 3,291,336 A 12/1966 Fraze
3,424,337 A 1/1969 Von Stocker
3,941,277 A 3/1976 McKinney et al.
3,957,005 A 5/1976 Heffner
3,967,752 A 7/1976 Cudzik
4,015,744 A 4/1977 Brown
4,024,981 A 5/1977 Brown
4,030,631 A 6/1977 Brown
4,031,837 A 6/1977 Jordan
D244,915 S 7/1977 Cudzik
4,061,243 A 12/1977 Khoury
4,062,471 A 12/1977 Perry
4,084,721 A 4/1978 Perry
4,109,599 A 8/1978 Schultz
4,130,219 A 12/1978 Mallorca
4,175,670 A 11/1979 Reynolds et al.
4,184,607 A 1/1980 Potts
4,205,760 A 6/1980 Hasegawa
4,210,257 A 7/1980 Radtke
4,211,335 A 7/1980 Langseder
4,217,843 A 8/1980 Kraska
4,266,688 A 5/1981 Reid
4,276,993 A 7/1981 Hasegawa
4,305,523 A 12/1981 Dalli et al.
D263,802 S 4/1982 Fraze
D263,803 S 4/1982 Fraze
D265,463 S 7/1982 Hasegawa
D266,991 S 11/1982 Hasegawa et al.
4,361,251 A 11/1982 Langseder et al.
D267,393 S 12/1982 Gruodis et al.
4,363,419 A 12/1982 Walz, Sr.
4,387,827 A 6/1983 Ruemer, Jr.
4,420,283 A 12/1983 Post
4,434,641 A 3/1984 Nguyen
4,465,204 A 8/1984 Kaminski et al.
D275,373 S 9/1984 Brown et al.
RE31,702 E 10/1984 Brown
4,516,420 A 5/1985 Bulso, Jr. et al.
D279,265 S 6/1985 Turner et al.
4,530,631 A 7/1985 Kaminski et al.
4,549,424 A 10/1985 Bulso, Jr. et al.
4,559,801 A 12/1985 Smith et al.
4,561,280 A 12/1985 Bachmann et al.
4,571,978 A 2/1986 Taube et al.
4,577,774 A 3/1986 Nguyen
4,606,472 A 8/1986 Taube et al.
4,641,761 A 2/1987 Smith et al.
4,704,887 A 11/1987 Bachmann et al.
4,713,958 A 12/1987 Bulso, Jr. et al.
4,716,755 A 1/1988 Bulso, Jr. et al.
4,722,215 A 2/1988 Taube et al.
4,733,793 A 3/1988 Moen
4,735,863 A 4/1988 Bachmann et al.
4,749,100 A 6/1988 Eberhart
4,790,705 A 12/1988 Wilkinson et al.
4,796,772 A 1/1989 Nguyen
4,804,104 A 2/1989 Moen
4,808,052 A 2/1989 Bulso, Jr. et al.
4,832,223 A 5/1989 Kalenak et al.
D302,116 S 7/1989 Cassai et al.
4,862,722 A 9/1989 Fraze et al.
4,865,506 A 9/1989 Kaminski
4,872,597 A 10/1989 Hanafusa
4,880,136 A 11/1989 Englert
RE33,217 E 5/1990 Nguyen
4,928,844 A 5/1990 LaBarge
4,930,654 A 6/1990 Thibeault et al.
4,930,658 A 6/1990 McEldowney
4,991,735 A 2/1991 Biondich
4,994,009 A 2/1991 McEldowney
5,011,037 A 4/1991 Moen et al.
D318,225 S 7/1991 Cassai et al.
D319,580 S 9/1991 Cassai et al.
D320,153 S 9/1991 Cassai et al.
5,046,637 A * 9/1991 Kysh ..... 413/8
5,064,087 A 11/1991 Koch
D327,424 S 6/1992 Pierce
5,119,664 A 6/1992 Schubert
5,129,541 A 7/1992 Voigt et al.
5,149,238 A 9/1992 McEldowney et al.
D332,750 S 1/1993 Moloney et al.
5,199,591 A 4/1993 Thibeault et al.
D338,156 S 8/1993 Cook
5,287,718 A 2/1994 Yamanashi
D346,745 S 5/1994 Heynen et al.
D347,172 S 5/1994 Heynen et al.
5,307,947 A 5/1994 Moen et al.
5,375,729 A 12/1994 Schubert
5,385,254 A 1/1995 Hannon
5,405,039 A 4/1995 Komura
5,456,378 A 10/1995 DeMars
D364,807 S 12/1995 Taylor
D365,988 S 1/1996 Clarke, III
D371,073 S 6/1996 Taylor
D382,481 S 8/1997 McEldowney
D385,192 S 10/1997 Hurst et al.
5,692,636 A 12/1997 Schubert
5,711,448 A 1/1998 Clarke, III
5,715,964 A 2/1998 Turner et al.
5,738,237 A 4/1998 McEldowney
D396,635 S 8/1998 McEldowney
D397,296 S 8/1998 McEldowney et al.
D402,555 S 12/1998 McEldowney et al.
5,860,553 A 1/1999 Schubert
5,875,911 A 3/1999 McEldowney
5,934,498 A 8/1999 Jordan
6,024,239 A 2/2000 Turner et al.
6,065,634 A 5/2000 Brifcani et al.

FOREIGN PATENT DOCUMENTS

EP 0 191 271 A2 8/1986
EP 0 381 888 B1 8/1990
EP 0 564 725 A1 10/1993
EP 0 704 382 A2 4/1996
EP 0 497 346 B1 9/1996
GB 2 067 159 A 7/1981
GB 1 604 068 12/1981
GB 2 193 140 A 2/1988
JP 1-308744 12/1989
JP 6-24443 2/1994
WO WO 97/29960 A2 8/1997
WO WO 98/34743 A1 8/1998

OTHER PUBLICATIONS

Davis, Tim, "Packaging Priorities," *Beverage World*, Dec. 1994, pp. 58, 60, 62 and 64.

* cited by examiner

CAN END FOR A CONTAINER

RELATED APPLICATION

This application is a continuation of U.S. application Ser. No. 09/748,927, which was filed on Dec. 27, 2000 now abandoned.

TECHNICAL FIELD

The present invention relates to end closures for two-piece beer and beverage metal containers having a non-detachable operating panel. More specifically, the present invention relates to improved forming techniques to produce a lightweight end closure.

BACKGROUND OF THE INVENTION

Common end closures for beer and beverage containers have a central panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin plate of aluminum. End closures for such containers are also typically constructed from a cut-edge of thin plate of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

These types of "stay-on-tab" ecology container ends have been used for many years, with a retained tab and a tear panel of various different shapes and sizes. Throughout the use of such ends, manufacturers have sought to save the expense of the metal by down-gauging the metal of the ends and the tabs. However, because ends are used for containers with pressurized contents and are sometimes subject to pasteurization, there are conditions causing great stresses to the components of the end during pasteurization, transit and during opening by a user. These conditions limit the available gauge reduction of the end metal, and make it difficult to alter design characteristics of the end, such as by reducing metal gauge or the thickness of the metal residual in the score defiling the tear panel.

The pressurized contents of the container often causes the end to buckle. The pressurized contents will also force the tabs upwardly. There is a maximum allowable distance that the tab can be displaced without the tab extending upwardly above the remainder of the container. This is called tab-over-chime. Tab-over-chime leads to ship abuse problems wherein the frangible panel prematurely fractures during distribution of filled beverage containers.

As manufacturers reduce the thickness of the metal used to make the ends, buckle and tab-over-chime become more and more of a problem. Therefore, a need for can end with improved ability to withstand buckle and tab-over-chime is needed.

SUMMARY OF THE INVENTION

It is an object of the present invention to provide an end closure for a container having a circumferential sidewall and a peripheral seaming edge adapted to be integrally connected to the sidewall. The end has a central panel wall with a deboss portion recessed therein. The deboss panel includes a means for opening a frangible panel segment of the panel wall and a rivet adapted to integrally attach a tab lever having a nose portion overlying at least a vent region of the frangible panel segment and a lift end opposite the nose. A score groove is formed in the central panel wall to define an outer perimeter of the frangible panel. The score groove has a first end adjacent the vent region and a second end joined to the first end by a curvilinear segment, whereby the first end and the second end are separated by a generally linear hinge segment of the central panel wall. The hinge segment is non-frangible to integrally connect the frangible panel segment to an adjacent area of the panel.

It is also an object of the present invention to provide such an end member wherein the central panel has a stepped profile along an outer peripheral portion.

It is another object of the present invention to provide an end member whereby the score groove is a generally v-shaped recess having a score depth into the thickness of the central panel, and the second groove is also a generally v-shaped recess having a groove depth into the thickness of the central panel less than that of the score groove. The score groove includes a check slot region for naturally slowing the fracture of the score to allow the container to vent safely.

It is further an object of the invention to provide an end member having a countersink with an inner wall, a curved segment, and an outer wall. The outer wall has a lower portion joined to an outer arcuate portion of the curved segment, a crease portion angled outwardly of the central panel, and an upper portion.

Other features and advantages of the invention will be apparent from the following specification taken in conjunction with the following drawings.

DETAILED DESCRIPTION

Figure 1:
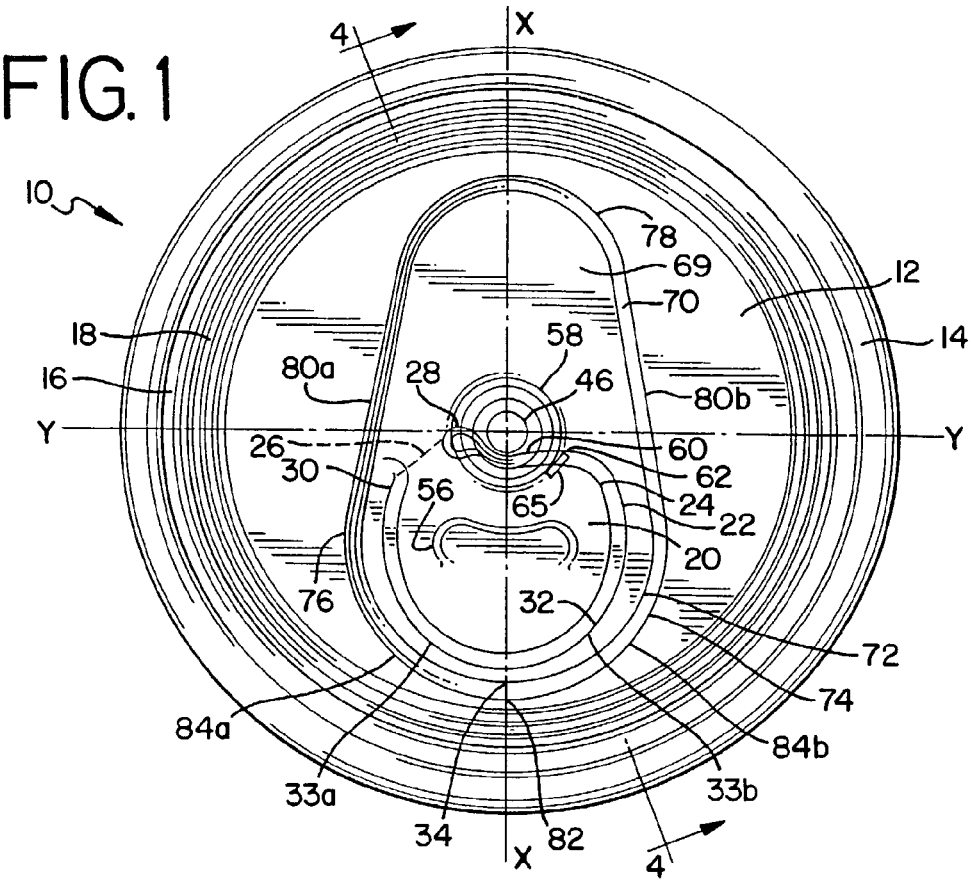
FIG. 1 is a top view of a can end of the present invention without a tab.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved physical properties including strength. Essentially, the present invention provides a lightweight end member 10 which embodies the physical characteristics and properties required in the beverage container market, as explained below.

In the embodiment of FIGS. 1 through 6, the end member 10 for a container (not shown) has a central panel wall 12 having a seaming curl 14 for joining the wall to the container. The container is typically a drawn and ironed metal can, usually constructed from a thin plate of aluminum or steel, such as the common beer and beverage containers. End closures for such containers are also typically constructed from a cut edge of thin plate of aluminum or steel, formed into blank end, and manufactured into a finished end by a process often referred to as end conversion. In the embodiment shown in the Figures, the central panel 12 is joined to a container by a seaming curl 14 which is joined to a mating curl of the container. The seaming curl 14 of the end closure 10 is integral with the central panel 12 by a countersink area 16 which is joined to the panel outer peripheral edge 18 of the central panel 12. This type of means for joining the central panel 12 to a container is presently the typical means for joining used in the industry, and the structure described above is formed in the process of forming the blank end from a cut edge of metal plate, prior to the end conversion process. However, other means for joining the central panel 12 to a container may be employed with the present invention.

The outer peripheral edge 18 of the central panel 12 is typically coined to add strength to can end 10. Coining is the work hardening of metal between tools. The metal is typically compressed between a pair of tools, generally an upper and lower tool.

The central panel wall 12 has a displaceable tear panel 20 defined by a curvilinear frangible score 22 with an adjacent anti-fracture score 24 on the tear panel 20, and a non-frangible hinge segment 26. The hinge segment 26 is defined by a generally straight line between a first end 28 and a second end 30 of the frangible score 22. The tear panel 20 of the central panel 12 may be opened, that is the frangible score 22 may be severed and the tear panel 20 displaced at an angular orientation relative to the remaining portion of the central panel 12, while the tear panel 20 remains hingedly connected to the central panel 12 through the hinge segment 26. In this opening operation, the tear panel 20 is displaced at an angular deflection, as it is opened by being displaced away from the plane of the panel 12.

The first and second ends 28, 30 of the frangible score 22 are joined by a curvilinear segment 32. The curvilinear segment 32 includes first and second curved segments 33*a*, 33*b* joined by an arcuate transition region 34 which lies adjacent the outer peripheral edge 18 of the center panel 12 and are defined by a radius of curvature $R_4$. (See FIG. 5). The first and second curved segments 33*a*, 33*b* are separated by a series of chordal lengths 31*a*–33*d*. (See FIG. 5).

Figure 3A:
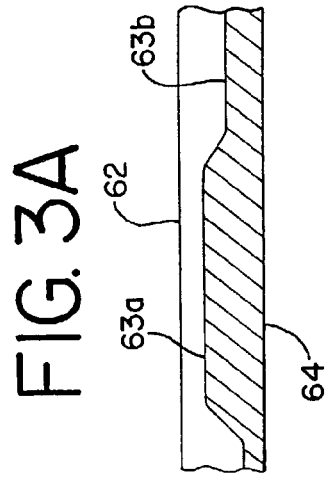
FIG. 3A is a partial cross-sectional view of taken along 3A—3A of FIG. 2.
Figure 3B:
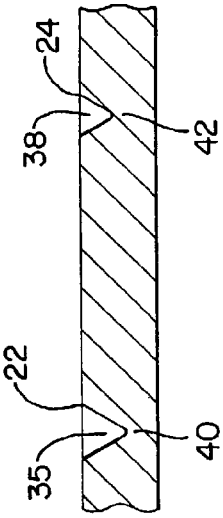
FIG. 3B is a partial cross-sectional view of taken along 3B—3B of FIG. 2.
Figure 2:
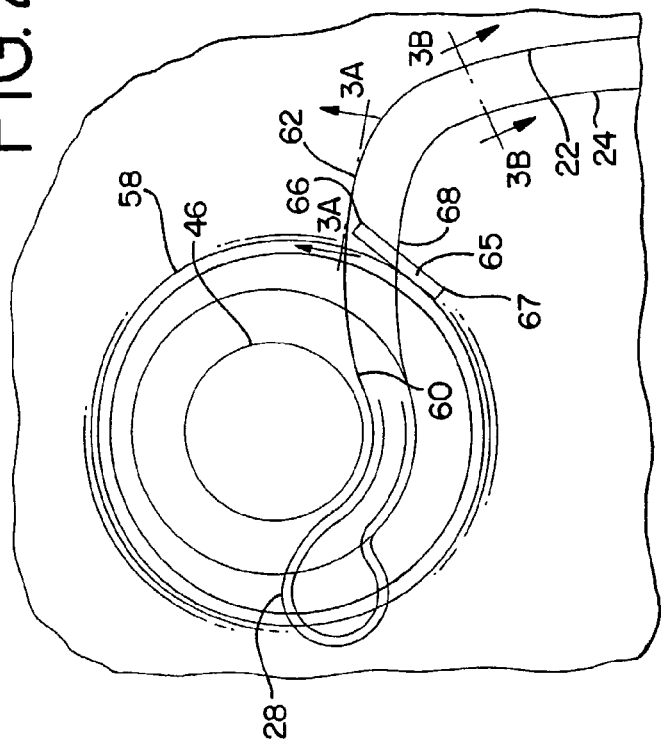
FIG. 2 is a partial top view of the can end of FIG. 1.

As best shown in FIG. 3B, the frangible score 22 is preferably a generally V-shaped groove 35 formed into the public side 34*a* of the panel wall 12. Similarly, the anti-fracture score 24, is preferably a generally V-shaped groove 38 formed into the public side 34*a* of the panel wall 12 on the tear panel 20. As is explained in more detail below, the frangible score groove 35 is preferably deeper than the anti-fracture score groove 38. Accordingly, the score residual 40, being the amount of frangible material remaining below the frangible score groove 35, is less than the adjacent anti-fracture score residual 42. This difference between score residual 40 and adjacent anti-fracture score residual 42 is the score residual differential.

The frangible score 22 and the second groove or anti-fracture score 24 are formed using conventional-type of scoring operation during the can end forming process, using tools including an upper (public side) die with a score knife and a lower (product side) die with an anvil surface.

The score residual differential is adapted to provide a tear panel 20 with a score 22 more readily frangible than the anti-fracture score 24, a significant factor for providing efficient opening of the end member 10. Having a double score of a frangible score 22 and an anti-fracture score 24 wherein there is a score residual differential is common in the industry.

Figure 1A:
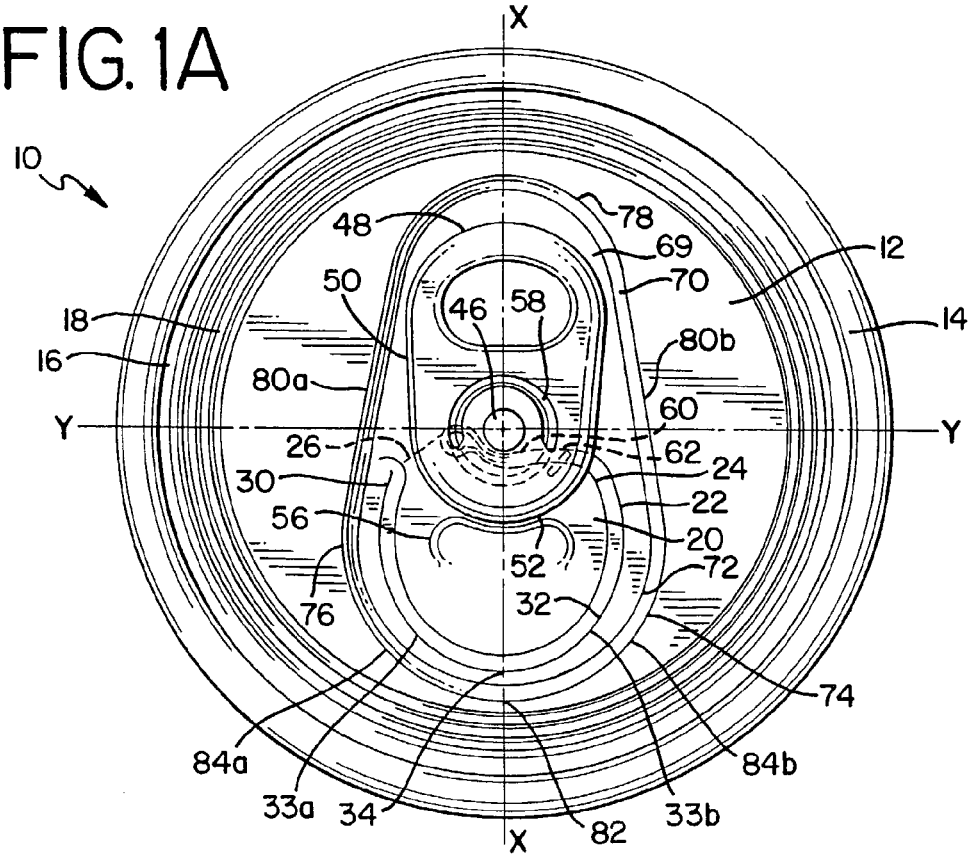
FIG. 1A is a top view of the can end of FIG. 1 with a tab staked thereto.

As illustrated in FIG. 1A, end member 10 has a tab 44 secured to the end panel 12 by a rivet 46. The tab 44 has a lift end 48, a central region 50, and a nose portion 52. The lift end 48 and the nose portion 52 are generally aligned along a central longitudinal axis passing through the rivet 46. A bead 56 is optionally formed in the tear panel 20 inward of the score 22 and the anti-fracture score 24. The tear panel bead 56 is useful to draw excess metal, or slack of metal, from the tear panel 20 to tighten the metal of the tear panel 20 and improve opening characteristics of the end member 10 by the tab 44 being lifted to push against the tear panel 20.

The rivet 46 is formed in the typical manner. It is the conventional practice to coin the metal on the central panel 12 proximate the base of the rivet 46 during formation thereof. When the rivet 46 is completely formed in the central panel 12, a coined region 58 having a generally circular periphery is also formed and is located about the rivet 46. This coined region 58 is typically called a button coin.

The user initiates opening of the end member 10 by lifting the lift end 48 of the tab 44. This lifts the rivet 46 which causes the score groove 22 to fracture in a vent region 60 which is located at least partially within the bounds of the coined region surrounding the rivet 46. As the nose portion 52 presses against the tear panel 20, the fracture of the score 22 propagates around the tear panel 20, preferably in progression from the first end 28 of the score 22 toward the second end 30 of the score 22.

The frangible score 22 includes a length defined by a thickened portion of the residual. This length is often referred to as a check slot region 62. As illustrated in FIG. 3A, the check slot 62 includes an area of thickened residual 64. The area thickened residual 64 causes the propagation of the fracture of the frangible score 22 to slow naturally as the fracture reaches the check slot region 62. This allows the container to vent safely before the fracture of the frangible score 22 continues.

Typically, the check slot 62 is located within the bounds of the coined region 58. The check slot 62 of the present invention, however, is located beyond the boundary of the coined region 58. Thus, the check slot 62 is not located within the thinned metal of the coined region 58 surrounding the rivet 46. This is advantageous for reasons which will be discussed below.

Preferably, the check slot region 62 includes a duel step residual differential. (See FIG. 3A). The dual step residual differential includes two levels of residual thickness. Thus, the check slot region 62, rather than having a constant residual thickness, includes a first step 63*a* wherein the residual differential between the first step 63*a* and substantially the remaining portions of the frangible score 22 is approximately 0.0020 inches and a second step 63*b* wherein the residual differential between the second step 63*b* and substantially the remaining portions of the frangible score 22 is approximately 0.0016 inches thick.

The end member 10 also includes a vent coin 65. The vent coin 65 is a small rectangularly shaped coin placed near the frangible score 22. The vent coin 65 has a leading end 66 placed adjacent the frangible score 22 and a trailing end 67 directed outwardly and at an angle from the frangible score 22. An intermediate section 68 of the vent coin 65 intersects the anti-fracture score 24.

One purpose of the vent coin 65 is to prevent the tear panel 20 from missiling during the opening of the container. Missiling is a jutting upward of the tear panel 20 upon venting. Missiling is caused when the frangible score 22 fracture propagates beyond the vent region 60, before the container pressure is fully relieved. The loose tear panel 20 is then forced upward due to the internal pressure of the container.

The end member 10 is opened by the lifting of the rivet and subsequently by the force of the tab 44 pushing down on the tear panel 20. Initially, the frangible score 22 should only be severed in the vent region 60. This allows a small portion of the tear panel 20 metal to be pushed below the central panel 12 to open and vent the pressure within the container.

The vent coin 65 functions by displacing metal near the juncture of the check slot 62 and the vent region 60. The displaced metal in the area causes an elastic, compressive state. As such, when the frangible score 22 is severed in the vent region 60, the metal of the tear panel 20 springs out to underlap the metal of the central panel 12 in that region. This underlapping portion of the tear panel 20 is believed to keep the remainder of the tear panel 20 in place so as to avoid premature fracture of the remainder of the frangible score 22 and thereby prevent the tear panel 20 from missiling.

Typically, the vent coin 65 is located within the coined region 58. Similar to the check shot 62 of the present invention, the vent coin 65 is moved outside of the periphery of the coined region 58 surrounding the rivet 46. It is believed that by moving the vent coin 62 outside of the coined region 58 boundary, the compressive stress on the frangible score 22 is increased. Therefore, the depth of frangible score 22 in the vent region 60 may be increased, and the strength requirement of the tab 44 to begin fracture of the frangible score 22 can be decreased.

The vent coin 65 also interacts with the check slot 62 to slow the propagation of the fracture along the frangible score 22 during venting of the container.

Figure 4:
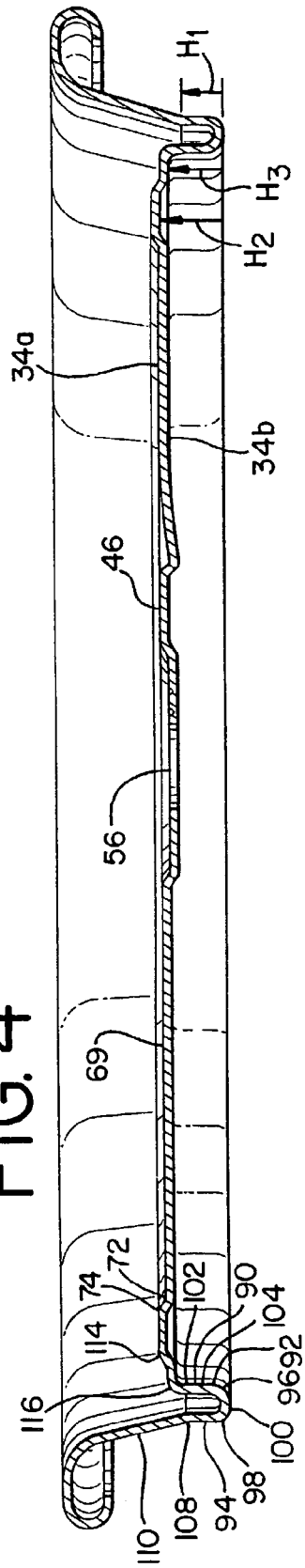
FIG. 4 is a cross-sectional view of the can end of FIG. 1 taken along 4—4.

According to another aspect of the present invention, a deboss panel 69 is formed in the public side 34*a* of the central panel 12. The deboss panel 69 is formed in the central panel 12 using conventional die-forming techniques. As shown in FIGS. 1 and 1A, the deboss panel 69 has a substantially gibbous-shaped deboss profile 70 which is, in turn, defined by an inner radius line 72 and an outer radius line 74. As illustrated in FIG. 4, the outer radius line 74 may have a radius of curvature of about 0.015 inches with a center of curvature below a product side 34*b* of the central panel 12 and the inner radius line 72 may have a radius of curvature of 0.015 inches with a center of curvature above public side 34*a* of the central panel 12. The depth of the deboss profile 70, i.e., the vertical distance between outer radius line 74 and inner radius line 72 may be about 0.019 inches. The width of the deboss profile, i.e., the lateral distance between the outer and inner radius lines 74, 72, may be about 0.015 inches. The deboss panel 69 has bilateral symmetry with respect to a plane defined by axes X—X and Y—Y.

The deboss profile 70 includes first and second opposing end portions 76, 78 joined by a pair of sidewalls 80*a*, 80*b*. The first end portion 76 includes an apex 82. The apex 82 is joined to the sidewalls 80*a*, 80*b* by first and second arcuate portions 84*a*, 84*b*. The apex 82 lies between the transition region 34 of the frangible score 22 and the outer peripheral edge 18 of the center panel 12. The first and second arcuate portions 84*a*, 84*b* extend outwardly equally from the apex 82 along a first angle such that a series of secant lengths 88*a*–88*d* arranged parallel to the Y—Y axis and opposite the apex 82 become progressively longer in length until the first and second arcuate portions 84*a*, 84*b* blend smoothly with the sidewalls 80*a*, 80*b*. (See FIG. 5). The apex 82 may also be described as having a radius of curvature $R_5$ wherein the arcuate portions 84*a*, 84*b* become increasingly farther and farther apart until each blends with a respective sidewall 80*a*, 80*b*.

Figure 5:
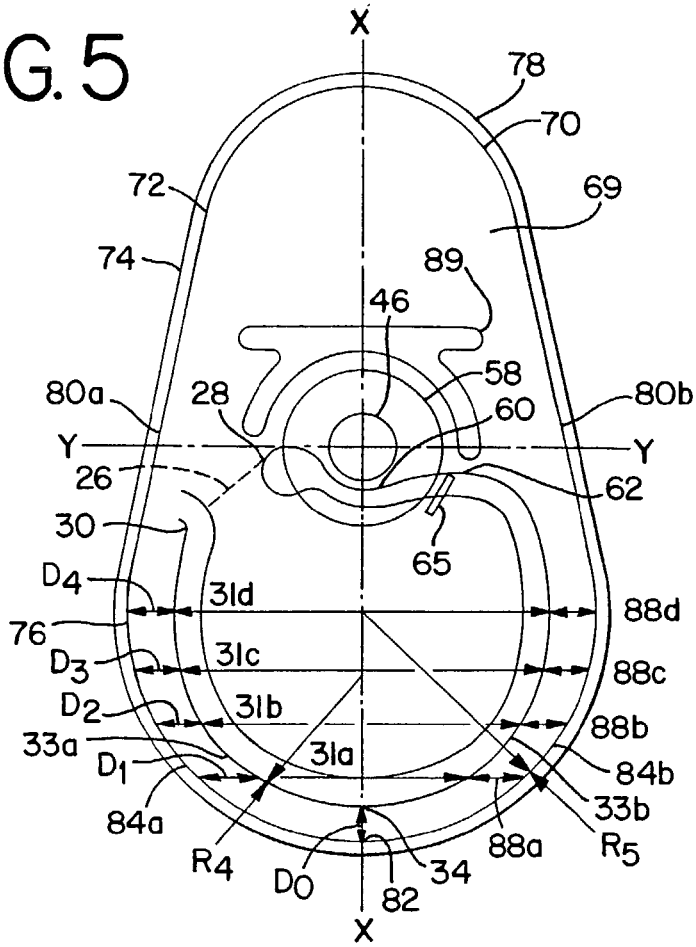
FIG. 5 is a partial view of a deboss panel of the present invention.

It should be noted that in the embodiment illustrated in FIG. 5, the sidewalls 80*a*, 80*b* are substantially straight segments. The sidewalls 80*a*, 80*b*, however, may curvilinear or any shape without departing from the spirit of the invention. For instance, FIG. 6 illustrates sidewalls 80*a*, 80*b* having a curvilinear shape.

Typically, the deboss profile 70 and the frangible score 22 remain equidistant throughout the first end portion 76. The distance between the frangible score 22 and the first end portion 68 of the deboss profile 70 is generally on the order of 0.05 inches.

As illustrated in FIG. 5, the present invention discloses a wideing of the distance between the first end portion 76 of the deboss profile 70 and the curved segments 33*a*, 33*b* of the frangible score 22. At the apex 82 of the first end portion 76, the distance $D_0$ between the deboss profile 70 and the frangible score 22 is about 0.05 inches. The distances $D_1$–$D_3$ increase gradually as the ratio of the secant lengths 88*a*–88*d* of the deboss profile 70 to the chordal lengths 31*a* –33*d* of the frangible score 22 increases. At the points where the first and second arcuate portions 84*a*, 84*b* blend into the sidewalls 82*a*, 82*b*, the distance $D_4$ between the deboss profile 70 and the frangible score 22 is about 0.1 inches.

Figure 6:
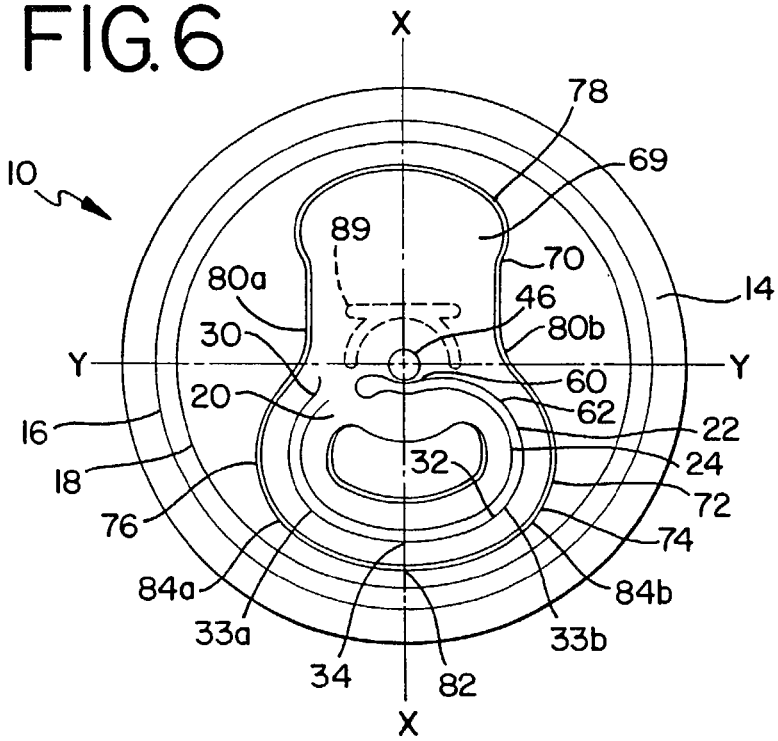
FIG. 6 is a top view of a can end of the present invention without a tab.

Alternatively, as illustrated in FIG. 6, the distance between the deboss profile 70 and the frangible score 22 can be increased while remaining substantially constant. In this embodiment, the distance between the deboss profile 70 and the frangible score 22 is increased from 0.050 inches to approximately 0.1 inches. The distance is preferably maintained at 0.1 inches but also may be within the range of 0.05–0.1 inches, or any range or combination of ranges therein.

The relationship between the deboss panel 69 and the frangible score 22 is important. The deboss panel 69 takes up metal displaced during the scoring process and the coining of the peripheral edge 18. Also, by moving the deboss panel 69 outwardly from the frangible score 22, it is believed that the stresses created on the frangible score 22 during the forming of the deboss panel 69 are greatly reduced. This is believed to enhance score rupturing by taking up metal slack near the rivet 46 and also immediately adjacent to the frangible score 22 along its entire length from the 6 o'clock past the 9 o'clock position, the region where score rupture failure is most likely to occur. Thus, the widening of the deboss panel 69 also increases burst values by relieving the stresses on the frangible score 22. The end member 10 is also strengthened because the movement of the deboss panel 69 outwardly allows the panel to be recessed deeper, taking up even more loose metal.

Generally, the central panel 12 experiences stress gradients. As the distance from the rivet 46 (center of the central panel 12) becomes greater, the stress lessens. Thus, by moving the deboss panel 69 away from the frangible score 22, the component of stress supplied by the deboss panel 69 is reduced. Thus, the depth of frangible score 22 may be increased as much as 50% without incurring premature failure of the frangible score 22.

According to another aspect of the present invention and as illustrated in FIGS. 5 and 6, a curvilinear bead 89 is formed in the public side 34*a* of the central panel 12. The bead 89 is preferably formed to have a curvilinear length, adapted to at least partially surround the coined region 58, thereby partially surrounding the rivet 46. Further, the bead 89 is preferably an emboss bead or a raised portion in the public side 34*a* of the central wall 12.

The bead 89 provides the desirable stiffness of the central panel 12 in the region around the rivet 46, thereby reducing the amount of panel lift resulting from the force of the tab 44 on the tear panel 20 during opening. The stiffness of the tear panel 20 is primarily provided by the bead 89 being formed as drawn metal in the public side 34*a* of the central panel 12 immediately adjacent the coined region 58 and the rivet 46.

The bead 89 preferably has an arcuate portion and a substantially linear portion. The arcuate portion partially surrounds the coined region 58, extending a slightly longer distance on one side of the coined region 58 than on an opposing side of the coined region 58. This allows the first end 28 of the score 22 to extend upwardly so that it wraps slights around the rivet 46. The substantially linear portion is located on an opposite side of the coined region 58 as the frangible score 22.

Preferably, there is very little thinning of the metal during formation of the bead 89, and the bead 89 is instead created by forming or drawing the metal between two opposed dies to take up slack metal. The bead 89 formation thereby draws available loose metal in the region, such as loose metal caused by scoring, coining of the metal while forming the rivet 46, or coining of metal while staking the tab 44. The bead 89 also serves as a stiffening beam in the panel 12 wall immediately adjacent the rivet 46 and the coined region 58. By drawing loose metal and providing a stiffening beam, the bead 89 is adapted to provide stiffness in the panel wall 12 around the coined region 58 to decrease the panel lift and enhance the leverage by the tab 44 during opening of the end tear panel 20.

Referring to FIG. 4, the countersink 16 of the end member 10 includes an inner wall 90, a curved segment 92, and an outer wall 94. The curved segment 92 has an inner arcuate portion 96 joined to an outer arcuate portion 98 along an annular base 100. The inner wall 90 has an upper portion 102 joined to the outer peripheral edge portion 18 of the central panel 12 and a lower portion 104 joined to the inner arcuate portion 96 of the curved segment 92. The outer wall 94 has a lower portion 106 joined to the outer arcuate portion 98 of the curved segment 92, a crease portion 108 angled outwardly of the central panel 12, and an upper portion 110. The crease 108 has a radius of curvature of approximately 0.005 inches and is positioned at a height $H_1$ of approximately 0.065 inches above the annular base 100.

The outer peripheral edge 18 of the central panel 12 includes a stepped profile. The stepped profile includes a first panel radius 114 interconnected to a second panel radius 116 by the previously coined portion of the outer peripheral edge 18. The first panel radius 114 has a height $H_2$ which is approximately 0.108 inches above the annular base 100. The second panel radius 116 is joined to the inner wall 90 of the countersink 16 and has a height $H_3$ which is approximately 0.093 inches above the annular base 100.

The dimensions of the first panel radius 114, the second panel radius 116, and the crease portion 108 were selected to optimize resistance to burst and tab-over-chime. Burst is the ability of the pour panel 20 to withstand internal pressure. Tab-over-chime is also the ability of the end member 10 to withstand internal pressure. Tab-over-chime occurs when the internal pressure forces the tab 44 upwardly. When the tab 44 is displaced upward, it can lead to ship abuse during distribution of filled containers which can cause premature failure of the pour panel 20. Thus, tab-over-chime is the internal pressure at which the tab is displaced an undesirable amount.

As the height $H_3$ of the second panel radius 116 increases, buckle values increase; however, the tab-over-chime value decreases as the height $H_3$ of the second panel radius 116 increases. Thus, the height $H_1$ of the crease portion 108 can be 0.060–0.075 inches or any height or range of heights therein, and the height $H_3$ of the second panel radius 116 can be 0.080–0.095 inches or any height or range of heights therein. It should be noted that for forming reasons, the height $H_1$ of the crease 108 is preferably lower than the height $H_3$ of the second panel radius 116.

According to another aspect of the invention, a method for reforming a can end shell to produce the end member 10 described herein is disclosed. The method is used to produce a lightweight end member 10, for example from an 0.0080 inch thick aluminum stock for attachment to a container necked to a 202 (2.125 inches) open end. End members 10 of the present invention are generally manufactured using a multi-stage reforming method.

In an the initial stage, the outer peripheral edge 18 of the central panel 12 is coined and reformed in the conventional manner. The coining operation creates slack metal produced by the compression of the peripheral edge 18 between the coining tools. This coining operation forces metal in the outer peripheral edge to flow both radially inwardly and radially outwardly from the peripheral edge 18.

The slack metal is removed as the countersink 16 is reformed. In this operation, the countersink 16 is reformed so that metal in the countersink 16 is moved downwardly with respect to the central panel 12. This decreases the countersink 16 depth which causes the central panel 12 height to increase. To further improve end member 10 rock and buckle performance, the outer wall of the countersink 16 may also be creased or kinked radially outwardly, as illustrated in FIG. 4, during the reforming operation. This type of operation is disclosed in U.S. Pat. No. 4,093,102.

Next, the deboss panel 69 is formed within the central panel 12. The forming of the deboss panel 69 places the central panel 12 into the desirable tension state. The deboss panel 69 also takes up any slack metal created during the coining of the peripheral edge 18 and the scoring of the central panel 12 when the frangible score 22 and the anti-fracture score 24 are formed.

Once the tab 44 has been staked to the rivet 46, the step portion is formed at the outer peripheral portion 18. The step portion increases the height of the central panel 12 above that of the initial reform increase. The forming of the step portion increases the end member's 10 buckle resistance even higher. Also, since no slack metal is remaining from the coining and scoring operations, it has been found that the deboss panel 69 will roll up or the recess will become shallower subsequent to the step portion being formed.

In an initial trial, can ends 10 were produced with a check slot region 62 having a single step of residual thickness of 0.0016 ins., a vent coin 65 positioned below the anti-fracture score 24, and a 6:00–12:00 score residual differential of only 0.0002–0.0004 ins. This trial resulted in improved openability.

A second trial was carried out on can ends 10 as illustrated in FIGS. 5. The lengths of increased residual 62 of these can ends 10 were modified to create the dual step residual differential to the frangible score 22 of 0.0020 ins. and 0.0016 ins. All of the can ends 10 exhibited improved openablility and passed the missing test. It is believed that these favorable results are attributable to the tear panel 20 hinging at, or opening to, the vent coin 65 when the can end 10 end is "popped" or when opening is initialized. This creates a larger vent opening and allows the can end 10 to vent and pass the missiling test.

Since the can ends 10 successfully passed the missilng test, a complete evaluation was performed. Further tests on a total of eight sets of can ends 10, as illustrated in FIGS. 1–4 were performed. All of the forming variables of the eight sets of can ends 10 were identical except for the score residuals of the frangible score 22. The different score residuals are summarized in Table 1.

TABLE 1

| | Score Residuals (in inches) | | | |
|---|---|---|---|---|
| Test Group | Residual at the 12:00 Position | Residual at the 3:00 Position | Residual at the 9:00 Position | Residual at the 6:00 Position |
| A | 0.0030 | 0.0029 | 0.0029 | 0.0028 |
| B | 0.0033 | 0.0033 | 0.0033 | 0.0032 |
| C | 0.0034 | 0.0034 | 0.0034 | 0.0032 |
| D | 0.0036 | 0.0035 | 0.0035 | 0.0034 |
| E | 0.0038 | 0.0037 | 0.0037 | 0.0035 |
| F | 0.0042 | 0.0042 | 0.0042 | 0.0040 |
| G | 0.0045 | 0.0044 | 0.0044 | 0.0041 |
| H | 0.0047 | 0.0046 | 0.0046 | 0.0043 |

The can ends 10 were also tested for pressurized openability (for beer). No failures were found until test group H.

The can ends 10 were further tested for score burst. None of the can ends 10 burst open before the maximum pressure of the test was reached. It is believed that the excellent results of this test are directly attributable to the greater distance from the deboss panel 69 to the frangible score 22.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of the particular embodiments disclosed herein as the best mode contemplated for carrying out the invention should not be limited to such details.

We claim:

1. An end member for a container, the end member having a central panel wall with a product side and a public side, the public side having a means for opening a frangible panel segment, the end member comprising:

a deboss panel recessed in the central panel, the deboss panel having a profile defined by first and second spaced apart end portions joined by first and second sidewalls;

a score groove within the deboss panel defining an outer perimeter of the frangible panel segment, the score groove having a portion adjacent the first spaced apart end portion of the deboss panel wherein a distance between the deboss profile and the score groove has a length greater than 0.060 inches wherein the first spaced apart end portion of the deboss panel includes first and second arcuate portions extending outwardly from an apex, and the distance between the score groove and the deboss profile becomes progressively longer along at least the first or second arcuate portion.

2. The end member of claim 1 wherein the distance between the deboss profile and the score groove is between 0.060 inches and 0.1 inches.

3. The end member of claim 1 wherein the first spaced apart end portion includes an apex and first and second arcuate portions joining the apex with the first and second sidewalls respectively wherein a distance between the first and second arcuate portions is defined by a plurality of progressively increasing secant lengths located in spaced relation from the apex, and the score groove includes a first end and a second end joined to the first end by a curvilinear segment, the curvilinear segment including a generally arcuate transition region adjacent the apex of the deboss panel, the generally arcuate transition region defined by a plurality of progressively increasing chordal lengths located in spaced relation from the apex of the deboss panel wherein a ratio of the plurality of progressively increasing secant lengths to the progressively increasing chordal lengths increases along respective lengths of the first and second arcuate portions of the deboss panel.

4. The end member of claim 3 further comprising:

a rivet located within the deboss panel and adapted to integrally attach a tab lever to the panel, the tab lever having a nose portion overlying at least a portion of the frangible panel and having a lift end opposite the nose; and a coined region having an outer periphery located about the rivet wherein the score groove has a portion separated from the product side of the central panel by a residual, and the score groove includes a vent region located within the coined region and adjacent the rivet, and a length defined by a thickened portion of the residual located beyond the periphery of the coined region wherein the frangible panel segment initially opens within the vent region in response to a pulling force on the lift end of the tab lever.

5. The end member of claim 4 further comprising a vent coin adjacent the length of the score groove defined by a thickened portion of the residual for placing a compressive stress on the length of the score groove defined by a thickened portion of the residual.

6. The end member of claim 4 further comprising an anti-fracture score adjacent the score groove wherein the vent coin intersects the anti-fracture score.

7. The end member of claim 1 wherein the central panel has an outer peripheral edge segment including a stepped portion having at least a first panel radius interconnected to a second panel radius.

8. The end member of claim 7 further comprising a countersink portion connected to the central panel by the outer peripheral edge portion, the countersink including an inner wall, a curved segment, and an outer wall, the curved segment having an inner arcuate portion joined to an outer arcuate portion along an annular base, the inner wall having an upper portion joined to the outer peripheral edge portion of the center panel and a lower portion joined to the inner portion of the curved segment, and the outer wall having a lower portion joined to the outer portion of the curved segment, a crease portion angled outwardly of the center panel, and an upper portion wherein the crease is positioned at a first height above the annular base and the second panel radius is positioned at a second height, the second height being greater than the first height.

9. An end member for a container having a circumferential sidewall, the end member having a peripheral seaming edge adapted to be integrally connected to the sidewall, and having a central panel wall with a product side and a public side, the public side having a means for opening a frangible panel segment, the end member comprising:

a rivet positioned within the central panel and adapted to integrally attach a tab lever to the panel, the tab lever having a nose portion overlying at least a portion of the frangible panel segment and having a lift end opposite the nose;

a coined region substantially surrounding the rivet, the coined region eeift having an outer periphery;

a score groove in the central panel defining an outer perimeter of the frangible panel segment, the score groove having a portion separated from the product side of the central panel by a residual thickness of the end member;

a vent region located adjacent the rivet, a portion of the vent region located within the coined region, the frangible panel segment opening initially within the vent region in response to a pulling force on the lift end of the tab lever; and a length of the score groove defined by a thickened portion of the residual located beyond the periphery of the coined region, the length of the score groove being bounded at opposing ends by portions of the score groove having a residual thickness less than the residual thickness of the length of the score groove defined by a thickened portion of the residual.

10. The end member of claim 9 further comprising a vent coin adjacent the length of the score groove defined by a thickened portion of the residual for placing a compressive stress on the length of the score groove defined by a thickened portion of the residual.

11. The end member of claim 10 further comprising an anti-fracture score adjacent the score groove wherein the vent coin intersects the anti-fracture score.

12. The end member of claim 11 wherein the vent coin is located beyond the periphery of the coined region substantially surrounding the rivet.

13. The end member of claim 12 wherein the length of the score groove defined by a thickened portion of the residual is located entirely beyond the periphery of the coined region substantially surrounding the rivet.

14. The end member of claim 9 wherein the central panel has an outer peripheral edge segment including a stepped portion having at least a first panel radius interconnected to a second panel radius.

15. The end member of claim 14 further comprising a countersink portion connected to the central panel by the outer peripheral edge portion, the countersink including an inner wall, a curved segment, and an outer wall, the curved segment including an inner arcuate portion joined to an outer arcuate portion along an annular base, the inner wall including an upper portion joined to the outer peripheral edge portion of the center panel and a lower portion joined to the inner portion of the curved segment, and the outer wall including a lower portion joined to the outer portion of the curved segment, a crease portion angled outwardly of the center panel, and an upper portion wherein the crease is positioned at a first height above the annular base and the second panel radius is positioned at a second height, the second height being greater than the first height.

16. The end member of claim 15 further comprising a deboss panel recessed in the central panel, the deboss panel including a profile defined by first and second spaced apart end portions joined by first and second sidewalls, the first spaced apart end portion including an apex and first and second arcuate portions joining the apex with the first and second sidewalls respectively wherein a distance between the first and second arcuate portions is defined by a plurality of progressively increasing secant lengths located in spaced relation from the apex, and the curvilinear segment of the score groove including a generally arcuate transition region adjacent the generally arcuate apex portion of the deboss panel, the generally arcuate transition region defined by a plurality of progressively increasing chordal lengths located in spaced relation from the apex of the deboss panel wherein a ratio of the plurality of progressively increasing secant lengths to the progressively increasing chordal lengths increases along respective lengths of the first and second arcuate portions of the deboss panel.

17. The end member of claim 9 wherein the thickened portion of the residual includes a first region and a second region, the residual located within the first region having a greater thickness than the residual located within the second region.

18. The end member of claim 17 wherein the first region is located adjacent the coined region substantially surrounding the rivet.

19. An end closure for a container, comprising:

a central panel having a public side and an opposing product side and an outer peripheral edge segment, the outer peripheral edge segment including a stepped portion including a first panel radius interconnected to a second panel radius;

a countersink connected to the central panel by the outer peripheral edge portion, the countersink including an inner wall, a curved segment, and an outer wall, the curved segment including an inner arcuate portion joined to an outer arcuate portion along an annular base, the inner wall including an upper portion joined to the outer peripheral edge portion of the center panel and a lower portion joined to the inner portion of the curved segment, and the outer wall including a lower portion joined to the outer portion of the curved segment, a crease portion angled outwardly of the center panel, and an upper portion wherein the crease is positioned at a first height above the annular base and the second panel radius is positioned at a second height, the second height being greater than the first height;

a seaming curl joined to the upper portion of the outer wall for joining the end closure to a container;

a rivet centrally recessed within the central panel and adapted to integrally attach a tab lever to the panel;

a coined region substantially surrounding the rivet, the coined region having an outer periphery;

a score groove in the central panel defining an outer perimeter of the frangible panel segment, the score groove having a first end and a second end joined to the first end by a curvilinear segment, the score groove including a portion separated from product side of the central panel by a residual;

a vent region, a portion of the vent region located within the coined region adjacent the rivet, the frangible panel segment opening initially within the vent region in response to a pulling force on the lift end of the tab lever;

a length of the score groove defined by a thickened portion of the residual located within the vent region and beyond the periphery of the coined region; and a vent coin adjacent the length of the score groove defined by a thickened portion of the residual for placing a compressive stress on the length of the score groove defined by a thickened portion of the residual.

20. The end closure of claim 19 further comprising an anti-fracture score adjacent the score groove wherein the vent coin intersects the anti-fracture score.

21. The end closure of claim 19 wherein the vent coin is located beyond the periphery of the coined region substantially surrounding the rivet.

22. The end closure of claim 19 further comprising a deboss panel recessed in the central panel, the deboss panel including a profile defined by first and second spaced apart end portions joined by first and second sidewalls, the first spaced apart end portion including an apex and first and second arcuate portions joining the apex with the first and second sidewalls respectively wherein a distance between the first and second arcuate portions is defined by a plurality of progressively increasing secant lengths located in spaced relation from the apex, and the curvilinear segment of the score groove including a generally arcuate transition region adjacent the generally arcuate apex portion of the deboss panel, the generally arcuate transition region defined by a plurality of progressively increasing chordal lengths located in spaced relation from the apex of the deboss panel wherein a ratio of the plurality of progressively increasing secant lengths to the progressively increasing chordal lengths increases along respective lengths of the first and second arcuate portions of the deboss panel.

23. An end member for a container, the end member comprising:

a central panel wall having a product side and a public side, the public side a frangible panel segment and a means for opening the frangible panel segment;

a deboss panel recessed in the central panel, the deboss panel having first and second spaced apart end portions joined by first and second sidewalls, the first spaced apart end portion having an apex segment at an outermost portion of the first spaced apart end portion relative to the second spaced apart end portion;

a score groove within the deboss panel defining an outer perimeter of the frangible panel segment, the score groove having a portion adjacent the apex segment of the first spaced apart end portion of the deboss panel defining a six o'clock position of the score groove wherein a distance between the deboss profile and the score groove increases in length between the six o'clock position of the score groove and a four o'clock position of the score groove.

24. The end member of claim 23 wherein the distance between the deboss profile and the score groove is greater than 0.050 inches.

25. The end member of claim 23 wherein the distance between the deboss profile and the score groove is between 0.050 inches and 0.1 inches.

26. The end member of claim 23 wherein the distance between the deboss profile and score groove increases in length between the six o'clock position of the score groove and an eight o'clock position of the score groove.

27. An end member for a container, the end member comprising:

a central panel wall having a product side and a public side, the public side a frangible panel segment and a means for opening the frangible panel segment;

a deboss panel recessed in the central panel, the deboss panel having first and second spaced apart end portions joined by first and second sidewalls, the first spaced apart end portion having an apex segment at an outermost portion of the first spaced apart end portion relative to the second spaced apart end portion;

a score groove within the deboss panel defining an outer perimeter of the frangible panel segment, the score groove having a portion adjacent the first spaced apart end portion of the deboss panel defining a six o'clock position of the score groove wherein a distance between the deboss profile and the score groove increases in length between the six o'clock position of the score groove and an eight o'clock position of the score groove.

28. The end member of claim 27 wherein the distance between the deboss profile and the score groove increases progressively between the six o'clock position of the score groove and the eight o'clock position of the score groove.

29. The end member of claim 27 wherein the distance between the deboss profile and score groove increases in length between the six o'clock position of the score groove and a four o'clock position of the score groove.

30. The end member of claim 29 wherein the distance between the deboss profile and the score groove increases progressively between the six o'clock position of the score groove and the four o'clock position of the score groove.

31. The end member of claim 29 wherein the distance between the deboss profile and the score groove increases progressively between the six o'clock position of the score groove and the eight o'clock position of the score groove and between the six o'clock position of the score groove and the four o'clock position of the score groove.

32. The end member of claim 29 wherein the distance between the deboss profile and the score groove is greater than 0.050 inches.

* * * * *

UNITED STATES PATENT AND TRADEMARK OFFICE

CERTIFICATE OF CORRECTION

PATENT NO. : 7,000,797 B2
APPLICATION NO. : 10/317636
DATED : February 21, 2006
INVENTOR(S) : Randy G. Forrest and Timothy Turner It is certified that error appears in the above-identified patent and that said Letters Patent is hereby corrected as shown below:

Col. 11, line 32 After "region" delete "eeift"

Signed and Sealed this

Twenty-seventh Day of May, 2008

JON W. DUDAS
*Director of the United States Patent and Trademark Office*